United States Patent [19]

Bächler

[11] 4,391,051

[45] Jul. 5, 1983

[54] MACHINE ARRANGEMENT FOR FORMING TRACKS AND/OR LEVELLING SURFACES RELATED TO CROSS-COUNTRY SKI TRAILS OR DOWNHILL SKI SLOPES

[76] Inventor: Anton R. Bächler, Seeburgstrasse 10, 6006 Luzern, Switzerland

[21] Appl. No.: 278,695

[22] Filed: Jun. 29, 1981

[30] Foreign Application Priority Data

Jul. 4, 1980 [CH] Switzerland ..... 5149/80

[51] Int. Cl.[3] ..... E01H 4/00; E01C 19/41

[52] U.S. Cl. ..... 37/223; 172/387; 172/199; 172/80; 172/63; 404/96

[58] Field of Search ..... 37/10, 42 UL, 43 R, 37/43 C–43 E, 219, 221–224; 172/387, 199, 63, 80; 404/96

[56] References Cited

U.S. PATENT DOCUMENTS

| | | | |
|---|---|---|---|
| 1,093,493 | 4/1914 | Stadig | 37/43 D |
| 2,384,441 | 9/1945 | Carter | 37/43 R |
| 2,755,092 | 7/1956 | Donahue | 37/117.5 X |
| 4,057,916 | 5/1977 | Miller | 37/43 D |

*Primary Examiner*—E. H. Eickholt
*Attorney, Agent, or Firm*—Yount & Tarolli

[57] ABSTRACT

An apparatus for making ski tracks and/or levelling ski slopes is mounted in front of a driving vehicle so as to be freely vertically movable relative to the vehicle to adjust its position to varying snow heights encountered in treating the snow cover. Front and rear supports such as sleds or rollers are pivotally mounted on the frame and support the apparatus on the snow cover. A rotating cutting tool for treating the snow is mounted on an arm which is pivotally joined to the frame, to allow the cutting tool to swing upward and downward relative to the frame in response to varying snow heights. The cutting tool support arm may be resiliently mounted to bias the cutting tool in a downward direction to provide a flatter snow surface. At least one of the front and rear supports may be swingably mounted similarly to the cutting tool. The apparatus produces a flatter snow cover in areas of varying length of waves in the snow surface.

17 Claims, 2 Drawing Figures

Figure 1:
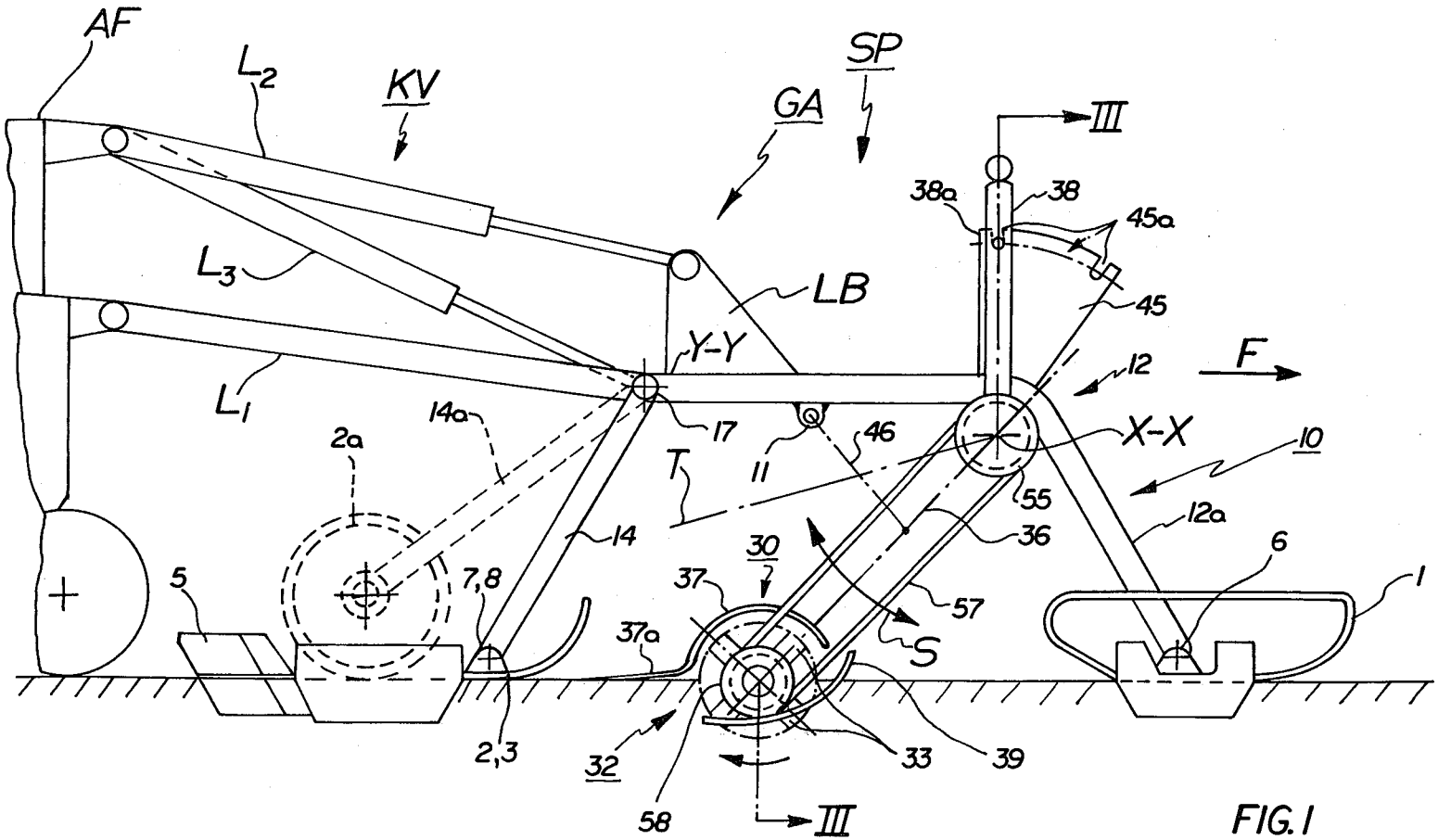

MACHINE ARRANGEMENT FOR FORMING TRACKS AND/OR LEVELLING SURFACES RELATED TO CROSS-COUNTRY SKI TRAILS OR DOWNHILL SKI SLOPES

The present invention is related to apparatus for forming tracks for use as cross-country ski trails and for levelling surfaces for down-hill ski-slopes. An apparatus of this type is known from DE-OS2533831.

In the known device the levelling/track-forming apparatus is pulled by a driving vehicle, and is capable of operating in areas where the snow cover has been hardened by the weight of heavy vehicles passing thereover. In many cases this increases the difficulty of undertaking work of the present type. The object of the invention therefore, is to provide an apparatus, distinguished by being operable under difficult snow conditions.

In accordance with the present invention the solution to the problem is obtained through the features disclosed in claim 1. Accordingly, there is provided an apparatus for forming tracks and/or levelling surfaces which is mounted on the forward end of a driving vehicle and which is capable of providing a particularly satisfactory result in the preparation and levelling of the snow, and is unaffected by the type of snow cover. A motorized cutting tool for pulverizing this snow cover is mounted on the device. Such a construction can be employed to newly produce or to repair cross-country ski trails in the majority of cases.

In addition, such equipment may be useful in the primary task of the levelling of slopes, such as downhill ski slopes, bearing in mind the versatility of the apparatus which results from the employment of a motor driven cutting tool attached to the apparatus having a comparatively large range of adjustment, without thereby reducing the evenness of the results.

In substantially every case a balanced effect is obtained in areas where the snow cover contains small elevations and hollows. This is the result of the unequal arrangement of the front and rear supports, each of them being positioned reciprocally to one another. The short support rod for the cutting tool enables an approximately tangential alignment and a cutting path which will not be worn away through intensive use.

In one embodiment of the invention there is provided an adjustable extension limiting means, making it possible thereby to avoid an overly deep penetration of the snow cover in regions of soft snow, which would otherwise result in unevenness. In order to avoid such unevenness, a biasing means is provided which functions in a direction against the upward movement of the cutting tool. This provides that the bearing pressure produced during the sloughing action of the cutting tool into relatively steep elevations causes an especially strong damping effect on the cutting tool, in turn producing an intensive penetrating effect on the snow elevation.

In accordance with the invention there is provided a machine arrangement, attachable to a driving vehicle for making tracks and/or levelling surfaces for cross-country ski trails or downhill slopes, comprising: a ski arrangement having at least one flat or rollable front support, at least one flat or rollable rear support, at least one front and one rear ski, at least one cutting device for furrowing and/or pulverizing snow, positioned between said front and rear supports, characterized in that the track-making or levelling apparatus is positioned in front of the driving vehicle, said apparatus being vertically movable or adjustable in relation to the driving vehicle, and to the cutting device, said apparatus comprising a frame to which the cutting device is attached, and in that the front and rear supports are connected to bearing surface elements by hinged joints.

Figure 2:
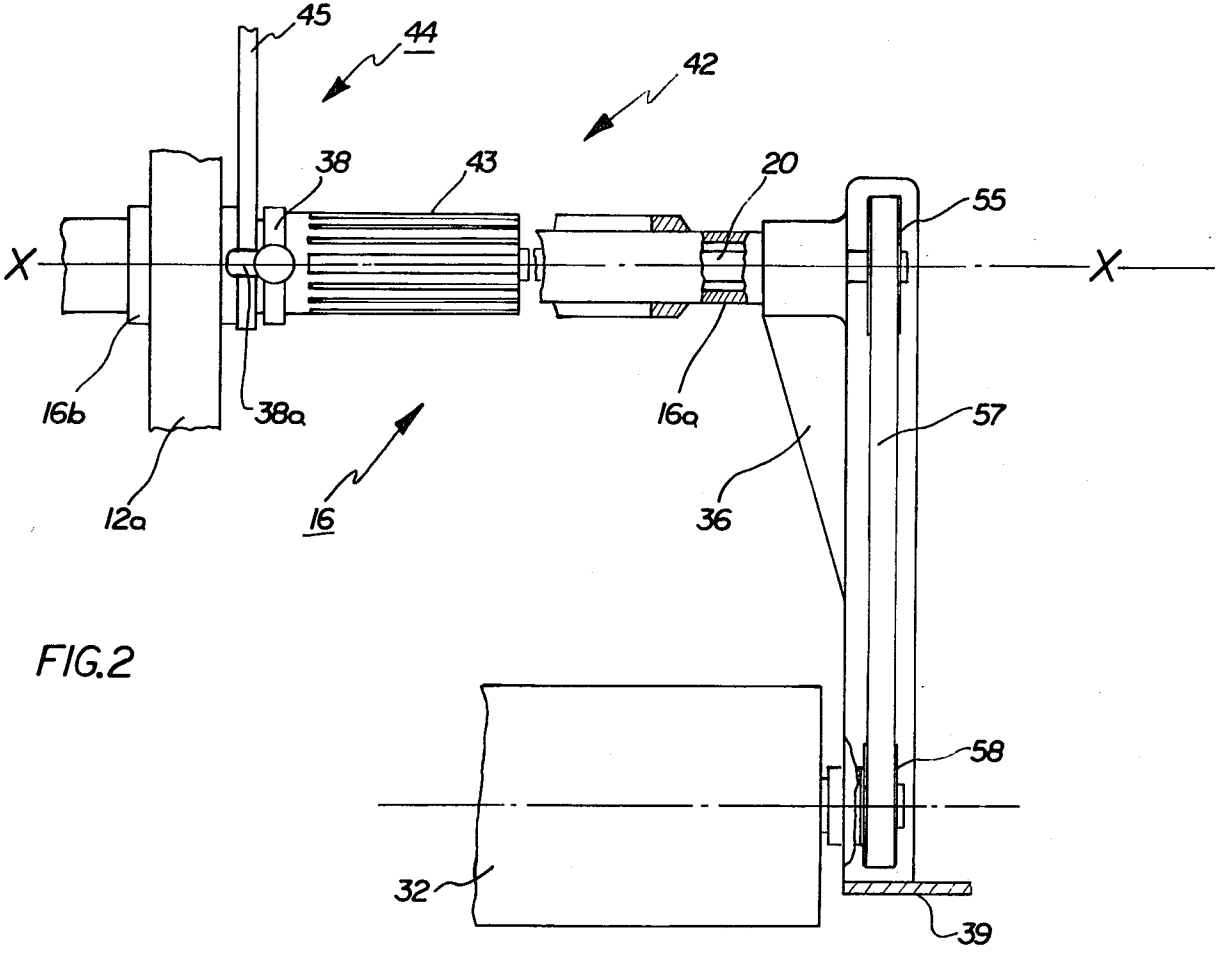

Further examples and advantages of the invention will be illustrated in the drawings, wherein:

FIG. 1 is a side view of a track-forming and levelling apparatus according to the invention, and FIG. 2 is a fragmentary plan view of the apparatus.

FIG. 1 indicates a track-forming and/or levelling device SP connected to the front end of a driving vehicle AF by means of a pair of forked guide rods $L_1$ whereby the driving force of the vehicle is transmitted. The apparatus SP can thereby be positioned to be freely movable in a vertical direction to alter its elevation height setting.

In an alternative embodiment, when only one support for the apparatus is provided, which is sufficient in many cases, the coupling arrangement can take the form of a parallelogram or trapezoidal control guide with a pair of additional rods $L_2$, and a hydraulic cylinder $L_3$ for lifting and lowering, so as to produce either a rigid or a movable mounting of the apparatus, respectively, as desired.

At the same time, a hinged link GA which is arranged horizontally and transversely to the direction of motion F, is arranged to the swing axis YY so as to provide free attitude adjustment of the apparatus SP, in the embodiment showing the plain guide rods $L_1$, with a bearing block LB, for attaching the guide rods $L_2$ and a corresponding rigid or likewise flexible inclination adjustment means for the apparatus being provided.

As shown in FIG. 1, the track making apparatus comprises a ski arrangement with a forward ski 1 and two rear skis 2, 3, positioned side by side in relation to the direction of travel F, and in spaced apart positions to each other. This arrangement is suitable for a dual track-forming process wherein a pair of track-forming elements 5 are attached to the rear skis. The front and rear skis are equipped with pivot mounts 6, and 7, 8, respectively. The front and rear skis are connected through a bent frame 10. The frame 10 comprises a main element 12 consisting of paired supports **12*a* positioned longitudinally in the direction of travel, and attached by means of a front transverse horizontal element 16, and a corresponding rear transverse element 17. The first element 16, spans the width of the apparatus, and comprises a hollow rod having a drive shaft 20 rotatably mounted therein for driving a cutting apparatus 30 positioned beneath the midsection of the frame. In order to vary the spacing between the dual tracks, outward and inward movable torsion rods 18 with carrying arm 14 for the rear skis 2, 3**, are provided.

The cutting apparatus 30 comprises a rotatable cutting tool 32, with cutting elements 33, disposed circumferentially around the tool which may, for example, consist of cutting knives positioned at angles inclined from the axis of rotation, or a curved or angular form for producing particularly intensive pulverizing action of the snow cover. The cutting instrument 32 shown in schematic form in FIG. 1, is supported at both ends by the swinging arms 36.

The swinging arms 36 are pivotally mounted on the transverse rod for pivotal movement about a horizontal axis X—X. Only one of the arms is illustrated in its schematic form in FIG. 1. Each arm 36 is attached to a tubular element 16*a* and journalled thereby in the transverse rod 16, and each arm is driven by the force of the operating cutting arrangement under tension so as to pivot in an arc S about the axis X—X. For that purpose the tubular element 16*a* is rotatably held upon the supports 12*a* of the frame 10 in supports 16*b* by means of a resiliently mounted torsion balance 42. This torsion balance comprises, for example, a torsion element 43, which is formed of multiple slotted segments in longitudinal alignment, with its outer end connected to the pivotally mounted element 16*a*, for example, by welding, as shown in FIG. 2. The inner end of the torsion element 43 is connected to the frame 10 through a pivot adjusting device 44 which holds the torsion element in a desired setting. The pivoting adjusting device 44 consists of ratchet 45, having a plurality of recesses 45*a* about its periphery, thereby to engage a lever 38 by means of a hinge pin 38*a*. The lever acts as a handle for adjusting the tension of the torsion element and can be neutrally adjusted, thereby to provide a suitable hand hold. The lever 38 having its lower end attached to the torsion element 43, enables the inner end of the torsion element to be tightened to the frame 10 in any desired position. At the neutral position, the outer ends of the torsion elements can be moved over the cut-off ends of the pivotal element 16*a* by stepped movements with elastic retractability. During upward swing motion of the arms there is an increase in pressure of the cutting tool against the snow cover, and during the downward swing, this pressure is decreased. The respective optimal pressure and its variation in relation to the pivoting movements can therefore be conveniently adjusted.

In order to obtain a firm, yet adjustable tension position of the cutting tool it is necessary to adjust the tension in a correspondingly rigid position, e.g., by substituting torsion elements of correspondingly high stiffness, namely elements with heavier segments, or shorter slots.

So that the movements and depth of penetration of the tool in the snow cover is in accordance with FIG. 1, a limiting means is provided in the form of a tensioning member 46 between one of the frame members 11 and the swing arm 36, such as e.g., a chain or length of cable. The adjustment of the torsion elements 43 can now be so selected, that the cutting arrangement 30 set to a high tension position by means at the tension member 46, remains under high tension, at all times, and during descent, places a progressively greater pressure on the snow cover.

I claim:

1. Apparatus for treating a snow cover of varying height to make tracks for ski trails and/or to level surfaces for ski slopes and adapted to be attached to and positioned in front of a driving vehicle, comprising a frame, at least one front support, at least one rear support, said front and rear supports being adapted to contact the snow cover and support the apparatus thereon, pivot means for connecting said front and rear supports to said frame, cutting means connected to said frame between said front and rear supports for treating the snow cover, and coupling means for attaching said frame to the driving vehicle, said coupling means being responsive to the height of the snow cover relative to the driving vehicle whereby said frame and thereby said cutting means may move vertically relative to the driving vehicle to adjust their vertical position to the height of the snow cover.

2. Apparatus as defined in claim 1, wherein said coupling means includes a hinged link mounted on the apparatus for connecting the apparatus to the front of the driving vehicle, said hinged link having a horizontal pivot axis positioned transversely to the longitudinal extent of the apparatus, said frame being pivotally mounted on said hinged link for pivotal movement about said horizontal pivot axis.

3. Apparatus as defined in claim 2, wherein said coupling means includes adjusting means whereby the apparatus can be moved relative to the driving vehicle to be selectively vertically positioned within an adjustment range.

4. Apparatus as defined in one of claims 2 or 3, wherein said coupling means includes adjustable powered stroke means for selectively positioning the apparatus at various heights.

5. Apparatus as defined in one of claims 1, 2, or 3, wherein said coupling means includes movable guide rod means extending between the driving vehicle and said frame for transmitting driving force from the driving vehicle to said frame and adapted to transmit driving force over a range of vertical position of said frame relative to the driving vehicle.

6. Apparatus as defined in claim 5, wherein said movable guide rod means comprises a plurality of guide rods at least partially defining a parallelogram or trapezoid, and wherein at least one of said plurality of guide rods comprises a hydraulic cylinder.

7. Apparatus as defined in claim 1, wherein at least one of said front and rear supports is selectively movable in the direction of the longitudinal extent of the apparatus within a range of movement as defined by the spacing between the supports and the frame and preferably slightly less than this spacing.

8. Apparatus as defined in claim 7, wherein at least one of said front and rear supports comprises a snow-contacting roller element connected to said frame by a supporting link, said roller element being rotatably connected to said supporting link.

9. Apparatus as defined in claim 1, wherein said cutting means is connected to said frame by support means which is adjustable so as to selectively vertically position said cutting means relative to said frame.

10. Apparatus as defined in claim 1, wherein said cutting means comprises at least one motorized rotary cutting tool connected to said frame by at least one support arm pivotally mounted on said frame.

11. Apparatus as defined in one of claims 1, 3 or 9, wherein said connection between said cutting means and said frame includes means for biasing said cutting means in a downward direction relative to said frame.

12. Apparatus as defined in claim 11, wherein said biasing means is adjustable to provide preselected amounts of biasing to said cutting means.

13. Apparatus for treating a snow cover of varying height to make tracks for ski trails and/or level surfaces for ski slopes and adapted to be attached to and positioned in front of a driving vehicle for driving said apparatus in a forward direction, comprising a frame, at least one front support and at least one rear support for contacting the snow cover and supporting the apparatus thereon, pivot means for pivotally connecting said front and rear supports to said frame, coupling means for attaching said frame to the driving vehicle, said coupling means being responsive to the height of the snow cover whereby the apparatus may move vertically relative to the driving vehicle to adjust its position to the varying height of the snow cover, said coupling means being adjustable so as to allow either preselection of a vertical position of said frame relative to the driving vehicle or free movement of said frame in a vertical direction relative to the driving vehicle, and cutting means connected to said frame between said front and rear supports for treating the snow cover, the connection between said cutting means and said frame including means for biasing said cutting means in a downward direction relative to said frame to yieldingly resist upward movement of said cutting means relative to said frame caused by increased height of the snow cover relative to said frame.

14. Apparatus as defined in claim 13, wherein at least one of said front and rear supports comprises a slidable ski support.

15. Apparatus as defined in claim 13, wherein at least one of said front and rear supports comprises a rollable support.

16. Apparatus as defined in claim 13, wherein said coupling means comprises a plurality of guide rods at least partially defining a parallelogram or trapezoid, at least one of said plurality of guide rods comprising a hydraulic cylinder which is operable to selectively position said frame at various heights relative to the driving vehicle.

17. Apparatus as defined in claim 16, wherein said cutting means comprises at least one motorized rotary cutting tool, and wherein said means for biasing said cutting means is adjustable to provide preselected amounts of biasing to said cutting means.

* * * * *